US008863864B1

(12) United States Patent
Miess

(10) Patent No.: US 8,863,864 B1
(45) Date of Patent: Oct. 21, 2014

(54) LIQUID-METAL-EMBRITTLEMENT RESISTANT SUPERABRASIVE COMPACT, AND RELATED DRILL BITS AND METHODS

(75) Inventor: David P. Miess, Highland, UT (US)

(73) Assignee: US Synthetic Corporation, Orem, UT (US)

( * ) Notice: Subject to any disclaimer, the term of this patent is extended or adjusted under 35 U.S.C. 154(b) by 509 days.

(21) Appl. No.: 13/116,566

(22) Filed: May 26, 2011

(51) Int. Cl.
*E21B 10/00* (2006.01)

(52) U.S. Cl.
USPC ..... 175/374; 175/425; 175/331

(58) Field of Classification Search
None
See application file for complete search history.

(56) References Cited

U.S. PATENT DOCUMENTS

| | | | |
|---|---|---|---|
| 4,268,276 | A | 5/1981 | Bovenkerk |
| 4,322,390 | A | 3/1982 | Tolley et al. |
| 4,410,054 | A | 10/1983 | Nagel et al. |
| 4,468,138 | A | 8/1984 | Nagel |
| 4,560,014 | A | 12/1985 | Geczy |
| 4,629,373 | A | 12/1986 | Hall |
| 4,738,322 | A | 4/1988 | Hall et al. |
| 4,811,801 | A | 3/1989 | Salesky et al. |
| 4,913,247 | A | 4/1990 | Jones |
| 4,951,762 | A | 8/1990 | Lundell |
| 4,984,642 | A | 1/1991 | Renard et al. |
| 4,993,505 | A | 2/1991 | Packer et al. |
| 5,016,715 | A | 5/1991 | Alasio |
| 5,016,718 | A | 5/1991 | Tandberg |
| 5,092,687 | A | 3/1992 | Hall |
| 5,120,327 | A | 6/1992 | Dennis |
| 5,135,061 | A | 8/1992 | Newton, Jr. |
| 5,154,245 | A | 10/1992 | Waldenstrom et al. |
| 5,180,022 | A | 1/1993 | Brady |
| 5,364,192 | A | 11/1994 | Damm et al. |
| 5,368,398 | A | 11/1994 | Damm et al. |
| 5,460,233 | A | 10/1995 | Meany et al. |
| 5,480,233 | A | 1/1996 | Cunningham |
| 5,512,235 | A | 4/1996 | Cerutti et al. |
| 5,544,713 | A | 8/1996 | Dennis |
| 5,558,170 | A | 9/1996 | Thigpen et al. |
| 5,667,028 | A * | 9/1997 | Truax et al. ..... 175/428 |
| 5,979,578 | A | 11/1999 | Packer |
| 6,135,219 | A | 10/2000 | Scott |
| 6,145,608 | A | 11/2000 | Lund et al. |
| 6,190,096 | B1 | 2/2001 | Arthur |
| 6,272,753 | B2 | 8/2001 | Packer |

(Continued)

FOREIGN PATENT DOCUMENTS

| | | |
|---|---|---|
| JP | H06-170571 | 6/1994 |

OTHER PUBLICATIONS

Davis, J.R. Editor, "Corrosion Behavior of Nickel and Nickel Alloys", Nickel, Cobalt, and Their Alloys, ASM Specialty Handbook, Jan. 1, 2000, pp. 157.

(Continued)

*Primary Examiner* — Jennifer H Gay
*Assistant Examiner* — Caroline Butcher
(74) *Attorney, Agent, or Firm* — Dorsey & Whitney LLP

(57) ABSTRACT

A superabrasive compact (e.g., a polycrystalline diamond compact) including a substrate and at least one feature for reducing the susceptibility of the substrate to liquid metal embrittlement during brazing operations is disclosed. The superabrasive compact may include a region between the substrate and a superabrasive table in which residual tensile stresses are located. The at least one feature may be disposed proximate to the region between the substrate and the superabrasive table in which residual tensile stresses are located.

24 Claims, 9 Drawing Sheets

(56) References Cited

U.S. PATENT DOCUMENTS

| | | | | |
|---|---|---|---|---|
| 6,419,034 | B1 | 7/2002 | Belnap et al. | |
| 6,460,637 | B1 | 10/2002 | Siracki et al. | |
| 6,793,681 | B1 | 9/2004 | Pope et al. | |
| 7,152,701 | B2 | 12/2006 | Butland et al. | |
| 7,316,279 | B2 | 1/2008 | Wiseman et al. | |
| 7,552,782 | B1 | 6/2009 | Sexton et al. | |
| 7,553,740 | B2 | 6/2009 | Sharp et al. | |
| 7,559,695 | B2 | 7/2009 | Sexton et al. | |
| 7,585,342 | B2 | 9/2009 | Cho | |
| 7,670,406 | B2 * | 3/2010 | Belashchenko | 75/252 |
| 7,866,418 | B2 | 1/2011 | Bertagnolli et al. | |
| 7,998,573 | B2 | 8/2011 | Qian et al. | |
| 8,020,471 | B2 | 9/2011 | Hall et al. | |
| 8,034,136 | B2 | 10/2011 | Sani | |
| 8,157,029 | B2 | 4/2012 | Zhang et al. | |
| 8,383,984 | B2 | 2/2013 | Osako et al. | |
| 8,393,419 | B1 | 3/2013 | Burton | |
| 8,534,391 | B2 | 9/2013 | Wirth | |
| 2004/0007394 | A1 | 1/2004 | Griffin | |
| 2005/0133277 | A1 | 6/2005 | Dixon | |
| 2007/0034147 | A1 | 2/2007 | Wort et al. | |
| 2008/0206576 | A1 * | 8/2008 | Qian et al. | 428/446 |
| 2009/0114628 | A1 | 5/2009 | DiGiovanni | |
| 2009/0242525 | A1 | 10/2009 | O'Brien et al. | |
| 2009/0260877 | A1 | 10/2009 | Wirth | |
| 2010/0270088 | A1 | 10/2010 | Zhang et al. | |
| 2010/0314176 | A1 * | 12/2010 | Zhang et al. | 175/383 |
| 2011/0017520 | A1 | 1/2011 | Webb | |
| 2011/0031036 | A1 | 2/2011 | Patel | |
| 2011/0073379 | A1 * | 3/2011 | DiGiovanni et al. | 175/428 |
| 2012/0048626 | A1 | 3/2012 | Bellin | |
| 2012/0175652 | A1 | 7/2012 | Chyr et al. | |

OTHER PUBLICATIONS

Davis, J.R., Editor, "Failures from Various Mechanisms and Related Environmental Factors", Metals Handbook Desk Edition, Second Edition (ASM International), published Dec. 1998, pp. 1231-1232.
Smith International, Geodiamond, "Quick Cutter", available as of Nov. 9, 2010, (3 pages).
U.S. Appl. No. 11/545,929, filed Oct. 10, 2006, Bertagnolli.
U.S. Appl. No. 12/558,939, filed Sep. 14, 2009, Miess et al.
U.S. Appl. No. 12/961,787, filed Dec. 7, 2011, Mukhopadhyay, et al.
U.S. Appl. No. 13/166,007, filed Jun. 22, 2011, Chapman, et al.
U.S. Appl. No. 13/234,252, filed Sep. 16, 2011, Gonzalez, et al.
Tze-Pin Lin, Michael Hood, George A. Cooper, and Redd H. Smith, Residual Stresses in Polycrystalline Diamond Compacts, J. Am. Ceram. Soc. 77[6] pp. 1562-1568 (1994).
U.S. Appl. No. 13/432,224, filed Mar. 28, 2012, Peterson et al.
Joseph, B., et al.—Liquid metal embrittlement: A state-of-the-art appraisal—The European Physical Journal Applied Physics, 1999.
Howes, "The Graphitzation of Diamond", 1962, Proc. Phys. Soc., vol. 80, pp. 648-662.
Pilkey, "Formulas for Stress, Strain, and Structural Matrices", 2005, John Wiley & Sons, 2nd Edition, pp. 255-305.
U.S. Appl. No. 13/166,007, Oct. 23, 2013, Office Action.
U.S. Appl. No. 13/234,252, Oct. 4, 2013, Office Action.
U.S. Appl. No. 13/234,252, Jan. 28, 2014, Office Action.

* cited by examiner

LIQUID-METAL-EMBRITTLEMENT RESISTANT SUPERABRASIVE COMPACT, AND RELATED DRILL BITS AND METHODS

BACKGROUND

Wear-resistant, superabrasive compacts are utilized in a variety of mechanical applications. For example, polycrystalline diamond compacts ("PDCs") are used in drilling tools (e.g., cutting elements, gage trimmers, etc.), machining equipment, bearing apparatuses, wire-drawing machinery, and in other mechanical apparatuses.

PDCs have found particular utility as superabrasive cutting elements in rotary drill bits, such as roller cone drill bits and fixed cutter drill bits. A PDC cutting element typically includes a superabrasive diamond layer commonly referred to as a diamond table. The diamond table is formed and bonded to a substrate using a high-pressure/high-temperature ("HPHT") process.

A fixed-cutter rotary drill bit typically includes a number of PDC cutting elements affixed to the bit body. PDC cutting elements are typically brazed directly into a preformed recess formed in a bit body of a fixed-cutter rotary drill bit. In some applications, the substrate of the PDC cutting element may be brazed or otherwise joined to an attachment member (e.g., a cylindrical backing), which may be secured to a bit body by press-fitting or brazing.

SUMMARY

Embodiments of the invention relate to a superabrasive compact (e.g., a PDC) including a substrate and at least one liquid-metal-embrittlement ("LME")-susceptibility-reducing feature designed to reduce the susceptibility of the substrate to liquid metal embrittlement during brazing operations. Drill bits including at least one of such superabrasive compacts are also disclosed, as well as methods of fabricating the drill bits and superabrasive compacts.

In an embodiment, a superabrasive compact includes a superabrasive table and a substrate having an interfacial surface bonded to the superabrasive table. The substrate also includes a base surface, and at least one peripheral surface extending between the base surface and the interfacial surface. The superabrasive compact further includes at least one LME-susceptibility-reducing feature disposed at least on and/or formed at least in the at least one peripheral surface of the substrate at least proximate to the interfacial surface thereof.

In an embodiment, a superabrasive compact includes a superabrasive table, and a substrate having an interfacial surface bonded to the superabrasive table. The substrate also includes a base surface and at least one peripheral surface extending between the base surface and the interfacial surface. At least one groove may be formed in the at least one peripheral surface, with the at least one groove located at least proximate to the interfacial surface. A filler may be disposed within at least a portion of the at least one groove. The at least one groove and/or the filler may help reduce or eliminate residual tensile stresses present at least proximate to the interfacial surface of the substrate to thereby reduce or eliminate the susceptibility of the superabrasive compact to LME.

Other embodiments are directed to drill bits including a plurality of superabrasive cutting elements. At least one of the superabrasive cutting elements may be configured according to any of the disclosed superabrasive compacts that are designed to be less susceptible to LME.

Other embodiments relate to applications utilizing the disclosed superabrasive compacts in various articles and apparatuses, such as bearing apparatuses, machining equipment, and other articles and apparatuses.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments of the invention, wherein identical reference numerals refer to identical elements or features in different views or embodiments shown in the drawings.

DETAILED DESCRIPTION

Embodiments of the invention relate to a superabrasive compact (e.g., a PDC) including a substrate and at least one LME-susceptibility-reducing feature designed to reduce the susceptibility of the substrate to LME during brazing operations. Drill bits including at least one of such superabrasive compacts are also disclosed, as well as methods of fabricating the drill bits and superabrasive compacts. It is believed that under certain conditions, when certain metallic materials (e.g., cemented carbide materials) exhibit a region of high residual tensile stresses therein and are exposed to certain liquid metals or alloys, a phenomenon known as LME may occur. When LME occurs, unexpected cracks may form in a region of the substrate, proximate to the superabrasive table of the superabrasive compact.

In some embodiments, the at least one LME-susceptibility-reducing feature includes at least one groove formed in the substrate to reduce or eliminate the residual tensile stresses present in the substrate. In other embodiments, the at least one LME-susceptibility-reducing feature includes a non-wettable component, such as a coating or other protective material that limits the extent to which the substrate can be wetted by an LME-causing braze alloy. Including a non-wettable element with the substrate enables a drill bit to be manufactured easily and rapidly by brazing the disclosed superabrasive compacts into a cutter recess with less risk of the superabrasive compact failing prematurely due to LME in a region proximate to the interface between the substrate and a superabrasive layer such as a PCD table.

While the description herein provides examples relative to a drill bit assembly, the superabrasive compact embodiments disclosed herein may be used in any number of applications. For instance, superabrasive compacts disclosed herein may be used in bearing apparatus, machining equipment, molding equipment, wire dies, bearings, artificial joints, inserts, heat sinks, and other articles and apparatuses, or in any combination of the foregoing.

Figure 1A:
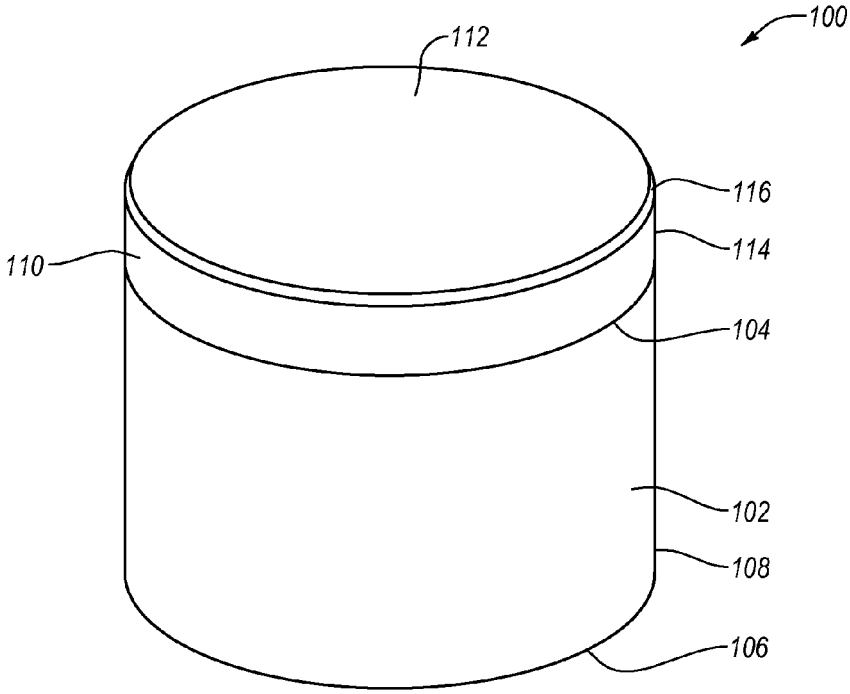
FIG. 1A is an isometric view of a superabrasive compact including a superabrasive table bonded to a substrate according to an embodiment.
Figure 1B:
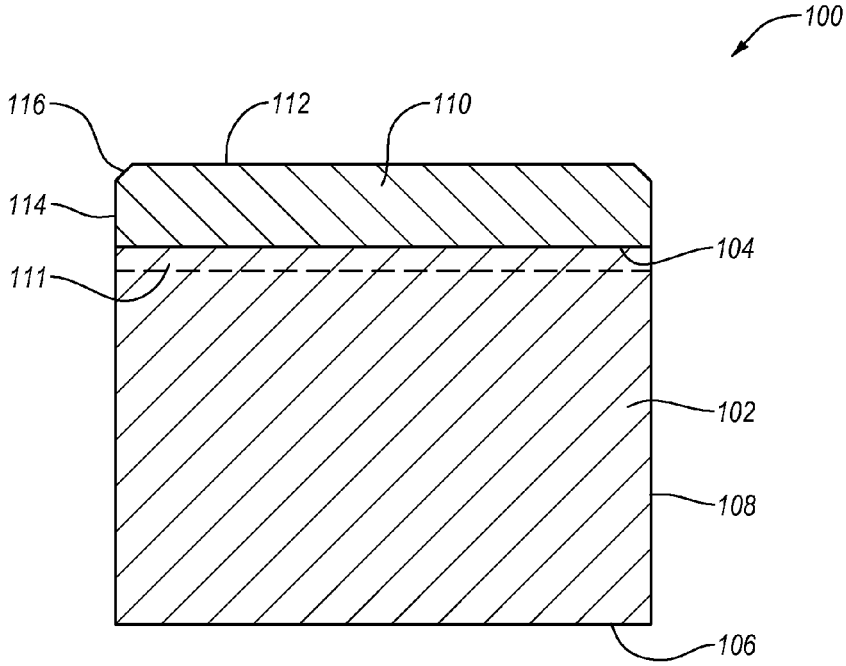
FIG. 1B is a cross-sectional view of the superabrasive compact shown in FIG. 1A taken along line 1B-1B.

FIGS. 1A and 1B are isometric and cross-sectional views, respectively, of a superabrasive compact 100 according to an embodiment. The superabrasive compact 100 includes a substrate 102 having an interfacial surface 104, a base surface 106 spaced from the interfacial surface 104, and at least one peripheral surface 108 extending between the interfacial surface 104 and the base surface 106. In the illustrated embodiment, the superabrasive compact 100 is cylindrical and the peripheral surface 108 is substantially continuous. However, in other embodiments, the superabrasive compact 100 may be non-cylindrical. Other shapes or configurations of a suitable superabrasive compact may include elliptical, rectangular, triangular, or other suitable configuration. Thus, in some embodiments, the peripheral surface 108 of the substrate 102 may be defined by multiple surfaces. Additionally, although the interfacial surface 104 is illustrated as being substantially planar, in other embodiments, the interfacial surface 104 may exhibit a selected non-planar topography.

The substrate 102 may include, without limitation, cemented carbides, such as tungsten carbide, titanium carbide, chromium carbide, niobium carbide, tantalum carbide, vanadium carbide, or combinations thereof cemented with iron, nickel, cobalt, or alloys thereof. For example, in an embodiment, the substrate 102 comprises cobalt-cemented tungsten carbide.

As further illustrated in FIGS. 1A and 1B, a superabrasive table 110 of the superabrasive compact 100 may be bonded to the interfacial surface 104 of the substrate 102. The superabrasive table 110 includes, in this embodiment, an upper surface 112, at least one peripheral side surface 114, and an optional chamfer 116 extending therebetween. The upper surface 112 and/or the side surface 114 may function as a cutting surface.

The superabrasive table 110 may be made from a number of different superabrasive materials. Suitable materials for use in the superabrasive table 110 include natural diamond, sintered polycrystalline diamond ("PCD"), polycrystalline cubic boron nitride, diamond grains bonded together with silicon carbide, or combinations of the foregoing. In one embodiment, the superabrasive table 110 is a PCD table that includes a plurality of directly bonded-together diamond grains exhibiting diamond-to-diamond bonding therebetween (e.g., $sp^3$ bonding), which define a plurality of interstitial regions. A portion of or substantially all of the interstitial regions of such a superabrasive table 110 may include a metal-solvent catalyst or a metallic infiltrant disposed therein that is infiltrated from the substrate 102 or from another source. For example, the metal-solvent catalyst or metallic infiltrant may be selected from iron, nickel, cobalt, and alloys of the foregoing. The superabrasive table 110 may further include thermally-stable diamond in which the metal-solvent catalyst or metallic infiltrant has been partially or substantially completely depleted from a selected surface or volume of the superabrasive table 110 using, for example, an acid leaching process.

In an embodiment, the superabrasive table 110 may be integrally formed with the substrate 102. For example, the superabrasive table 110 may be a sintered PCD table that is integrally formed with the substrate 102. In such an embodiment, the infiltrated metal-solvent catalyst may be used to catalyze formation of diamond-to-diamond bonding between diamond grains of the superabrasive table 110 from diamond powder during HPHT processing. In another embodiment, the superabrasive table 110 may be a pre-sintered superabrasive table that has been HPHT bonded to the substrate 102 in a second HPHT process after being initially formed in a first HPHT process. For example, the superabrasive table 110 may be a pre-sintered PCD table that has been leached to substantially completely remove metal-solvent catalyst used in the initial manufacture thereof and subsequently HPHT bonded or brazed to the substrate 102 in a separate process.

As discussed herein, in some embodiments, the superabrasive table 110 may be leached to deplete a metal-solvent catalyst or a metallic infiltrant therefrom in order to enhance the thermal stability of the superabrasive table 110. For example, when the superabrasive table 110 is a PCD table, the superabrasive table 110 may be leached to remove at least a portion of the metal-solvent catalyst from a working region thereof to a selected depth that was used to initially sinter the diamond grains to form a leached thermally-stable region. The leached thermally-stable region may extend inwardly from the upper surface 112, the side surface 114, and the chamfer 116 to a selected depth. Generally, the leached thermally-stable region extends from the upper surface 112 along only part of the height of the superabrasive table 110, as leaching at the interface between the substrate 102 and the superabrasive table 110 may deplete cobalt or another metal-solvent catalyst or metallic infiltrant, thereby weakening the bond between the substrate 102 and the superabrasive table 110. Thus, in a leaching process, the substrate 102 and an interior portion of the superabrasive table 110 may remain relatively unaffected. In one example, the selected depth may be about 10 μm to about 500 μm. More specifically, in some embodiments, the selected depth is about 50 μm to about 100 μm or about 200 μm to about 350 μm. The leaching may be performed in a suitable acid, such as aqua regia, nitric acid, hydrofluoric acid, or mixtures of the foregoing.

By way of illustration, one embodiment of a superabrasive compact 100 includes a cobalt-cemented tungsten carbide substrate 102 bonded to a PCD superabrasive table 110. Such structures may be fabricated by subjecting diamond particles, placed on or proximate to a cobalt-cemented tungsten carbide substrate, to an HPHT sintering process. The diamond particles with the cobalt-cemented tungsten carbide substrate may be HPHT sintered at a temperature of at least about 1000° Celsius (e.g., about 1100° C. to about 1600° C.) and a pressure of at least about 40 kilobar (e.g., about 50 kilobar to about 90 kilobar) for a time sufficient to consolidate and form a coherent mass of bonded diamond grains. In such a process, the cobalt from the cobalt-cemented tungsten carbide substrate may sweep into interstitial regions between the diamond particles to catalyze growth of diamond between the diamond particles. More particularly, following HPHT processing the superabrasive table 110 may comprise a matrix of diamond grains that are bonded with each other via diamond-to-diamond bonding and the interstitial regions between the diamond grains may be at least partially occupied by cobalt that has been swept in, thereby creating a network of diamond grains with interposed cobalt.

As described herein, bonding of the substrate 102 to the superabrasive table 110 may result in formation of a region 111 of high residual tensile stresses (e.g., greater than 40,000 psi) within the substrate 102. More particularly, when the superabrasive compact 100 is formed of a superabrasive table 110 made of PCD and bonded to a substrate 102 formed of, for example, cobalt-cemented tungsten carbide using an HPHT process, the region 111 of residual tensile stresses may form adjacent to the interfacial surface 104 of the substrate 102. Moreover, the region 111 may extend along substantially the full area of the interfacial surface 104 and to a particular depth profile from the interfacial surface 104.

The region 111 of residual tensile stresses may include tensile stresses that may compromise the toughness of the substrate 102 and the suberabrasive table 110. Moreover, if certain liquid metals (e.g., zinc-containing alloys) are applied to a side surface 208 of the substrate 102 in or near the region 111, the combination of the brazing conditions and certain liquid metals may cause LME to occur in the region 111 adjacent to the interfacial surface 104. For instance, the liquid metal may wet the substrate 102 at the region 111 of residual tensile stress and the brazing conditions may cause cracking in the region 111 of the substrate 102, which is a manifestation of LME.

Figure 2A:
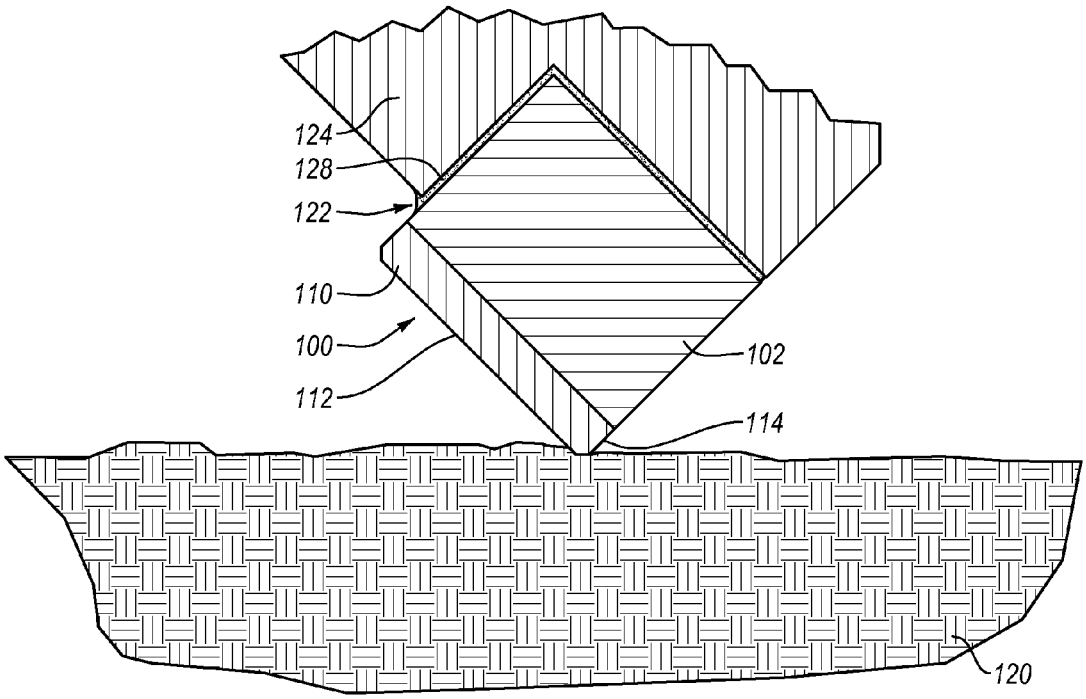
FIG. 2A is a cross-sectional view of a cutting assembly including a superabrasive compact brazed to a receptacle according to an embodiment.
Figure 2B:
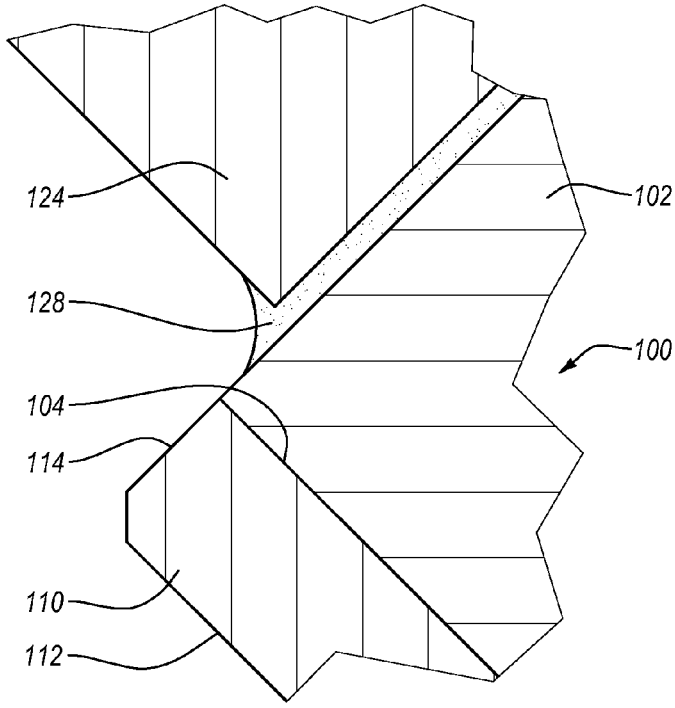
FIG. 2B is an enlarged partial view of the cutting assembly of FIG. 2A.

LME may be a concern for most brazing processes inasmuch as the process may include applying a liquid brazing alloy to the substrate 102. FIGS. 2A and 2B illustrate cross-sectional views of an application in which a brazing process may be utilized in connection with the superabrasive compact 100 of FIGS. 1A and 1B. In FIG. 2A, the superabrasive compact 100 is being used to cut into an earth formation 120, such as a subterranean formation. To facilitate use of the superabrasive compact 100 in this manner, the superabrasive compact 100 is secured within a recess 122 of a drill bit body 124. The drill bit body 124 may move along the earth formation 120 and cut into the earth formation 120 using the upper surface 112 and/or the side surface 114 of the superabrasive table 110.

The superabrasive compact 100 may be secured within the recess 122 in any suitable manner. For example, welding, mechanical fasteners, adhesives, or other processes or mechanisms may be used. Another process that may be used is brazing, which is described in more detail particularly with regard to FIG. 2B. Using brazing, the substrate 102 may be secured to one or more surfaces of the drill bit body 124, which may also be formed of a metal, alloy, an infiltrated carbide material, or combinations thereof. A filler metal 128 (e.g., a braze alloy) may be heated to slightly above its melting temperature, and allowed to flow between the substrate 102 and the drill bit body 124. In an embodiment in which the substrate 102 is cobalt cemented tungsten carbide, any of various braze alloys may be used. Suitable braze alloys may be selected from gold alloys, silver alloys, iron-nickel alloys, and other suitable braze alloys. In an embodiment, the braze alloy may include about 50 weight % ("wt %") silver, 20 wt % copper, 28 wt % zinc, and 2 wt % nickel, otherwise known as Silvaloy® A50N, which is currently commercially available from Wolverine Joining Technologies, LLC of Warwick, R.I. Other suitable braze alloys include AWS BAg-1 (44-46 wt % Ag, 14-16 wt % Cu, 14-18 wt % Zn, and 23-25 wt % Cd), AWS BAg-7 (55-57 wt % Ag, 21-23 wt % Cu, 15-19 wt % Zn, and 4.5-5.5 wt % Sn), and AWS BAg-24 (59-51 wt % Ag, 19-21 wt % Cu, 26-30 wt % Zn, and 1.5-2.5 wt % Ni).

In some cases, the filler metal 128 may fill a clearance between the substrate 102 and drill bit body 124 that is between about 0.03 mm to about 0.08 mm, although the clearance may be larger or smaller. For instance, the clearance may be between about 0.01 mm to about 1 mm. If the contact angle between droplets of the filler metal 128 and substrate 102 is sufficiently low, the liquid metal "wets" the substrate 102. Good wetting characteristics are typically desired for creation of high-quality brazed joints. However, as discussed herein, wetting may also lead to LME under certain conditions.

More particularly, if the residual tensile stresses proximate to the interfacial surface 104 are not eliminated or relieved, LME may result, thereby typically causing cracks to form in the substrate 102. The cracks may form at or near the interfacial surface 104 and may propagate as additional stress is applied to the superabrasive compact 100.

Embodiments disclosed herein relate to mechanisms for eliminating and/or reducing LME. According to various embodiments, such mechanisms may be used to perform one or more of: (i) modify the stress state in a superabrasive compact; or (ii) reduce wetting of selected regions of a superabrasive compact.

Figure 3A:
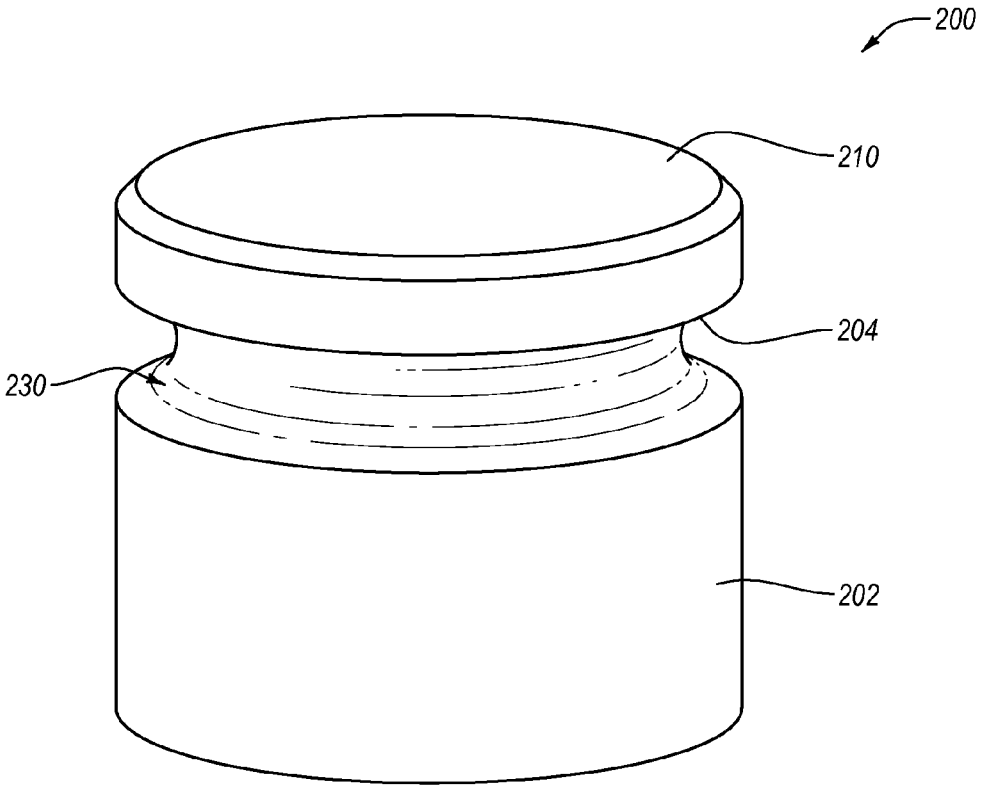
FIG. 3A is an isometric view of a superabrasive compact including a superabrasive table bonded to a substrate, with the substrate including at least one groove formed adjacent to an interface with the superabrasive table to improve a stress state at the interface according to an embodiment.

Turning now to FIG. 3A, an embodiment of a superabrasive compact 200 is illustrated. The superabrasive compact 200 includes a substrate 202 bonded to a superabrasive table 210, which may be made from any of the previously discussed materials for the superabrasive table 110 and the substrate 102. The substrate 202 and superabrasive table 210 may be bonded together in any suitable manner. For instance, the substrate 202 and superabrasive table 210 may be integrally formed using an HPHT sintering process as described herein, pre-formed and bonded to the substrate 202, or in any other suitable manner.

The substrate 202 and superabrasive table 210 abut each other at an interfacial surface 204 of the substrate 202. During formation (e.g., in an HPHT sintering process), the superabrasive table 210 and the substrate 202 of FIG. 3A may be formed to have a generally cylindrical shape, similar to that illustrated above with respect to FIG. 1A. Following an HPHT sintering, a pressing, or other formation process, the superabrasive compact 200 may be modified to include at least LME-susceptibility-reducing feature. For instance, in the illustrated embodiment, the superabrasive compact 200 includes at least one groove 230 formed therein. The groove 230 may act as an LME-susceptibility-reducing feature in that it partially or completely eliminates residual tensile stresses present in the substrate 202 at or near the interfacial surface 204.

More particularly, the groove 230 may be formed as an annular groove around all or a portion of the perimeter or circumference of the substrate 202. For example, the height of the annular groove 230 may be about 0.010 inch to about 0.140 inch (e.g., 0.75 inch to about 0.125 inch, or 0.90 inch to about 0.125 inch) and the radial depth of the annular groove 230 may be about 0.010 inch to about 0.110 inch (e.g., 0.050 inch to about 0.110 inch, or 0.070 inch to about 0.110 inch). In the illustrated embodiment, the annular groove 230 is also positioned proximate to the interfacial surface 204 of the substrate 202, and may be directly at the interfacial surface 204 or adjacent thereto. The positioning of the annular groove 230 at least proximate to the interfacial surface 202 may facilitate elimination of LME. In particular, as discussed herein, a region 211 (see FIG. 4) of residual tensile stresses may exist near the interfacial surface 204 of the substrate 202. The region 211 is illustrated as having arbitrary dimensions and may also extend to the groove 230. The annular groove 230 may be formed in an exterior peripheral side surface 208 of the substrate 202 and may modify the stress state in the region 211 of residual tensile stresses. In particular, in this embodiment, the stress state may be modified at the location of the groove 230, namely at a portion of the residual tensile stress region extending inward from the exterior peripheral side surface 208 of the substrate 202, and generally adjacent to the interfacial surface 204.

For instance, the superabrasive compact 200 may be initially formed through a desired process (e.g., an HPHT sintering process) and have a particular shape. Thus, the superabrasive compact 200 may have, for example, a generally cylindrical shape in which the groove 230 is absent. Following the initial formation of the superabrasive compact 200, grinding, milling, turning, other machining process (e.g., laser machining), etching, or any combination of the foregoing may be used to form the groove 230 into the substrate 202. During forming the groove 230, the stress state at or near the interfacial surface 204 may be modified to remove or reduce existing residual tensile stresses in the substrate 202.

Finite element modeling has shown that the maximum tensile stress responsible for LME at the exterior surface of the substrate 202 adjacent to the superabrasive table 210 may be reduced by the groove 230. For example, finite element modeling has shown that the maximum tensile stress responsible for LME at the exterior surface of the substrate 202 adjacent to the superabrasive table 210 may be reduced by about 20% to about 70% (e.g., about 30% to about 50%, about 40% to about 70%, or about 50% to about 60%) at elevated temperature (e.g., 700-750° C.) when the substrate 210 is brazed to another structure.

While the illustrated embodiment depicts the groove 230 as being positioned about adjacent the interfacial surface 204 of the substrate 202, the groove 230 need not be positioned immediately below the superabrasive table 210 or the interfacial surface 204. For instance, in other embodiments, a region of residual stresses may extend further through the substrate 202, or may be offset relative to the interfacial surface 204. In particular, a region of residual stresses may be influenced by numerous factors such as the thickness of the superabrasive table 210, an interface pattern between the substrate 202 and the superabrasive table 210, or based on other factors, or any combination of the foregoing. Thus, the groove 230 may be positioned in any number of different locations, and in some cases may even be angled relative to one or more of the superabrasive table 210, substrate 202, or interfacial surface 204. Such positioning may be based on finite element analysis, empirical data, or other information useful in indicating a likely region of residual stresses.

Figure 3B:
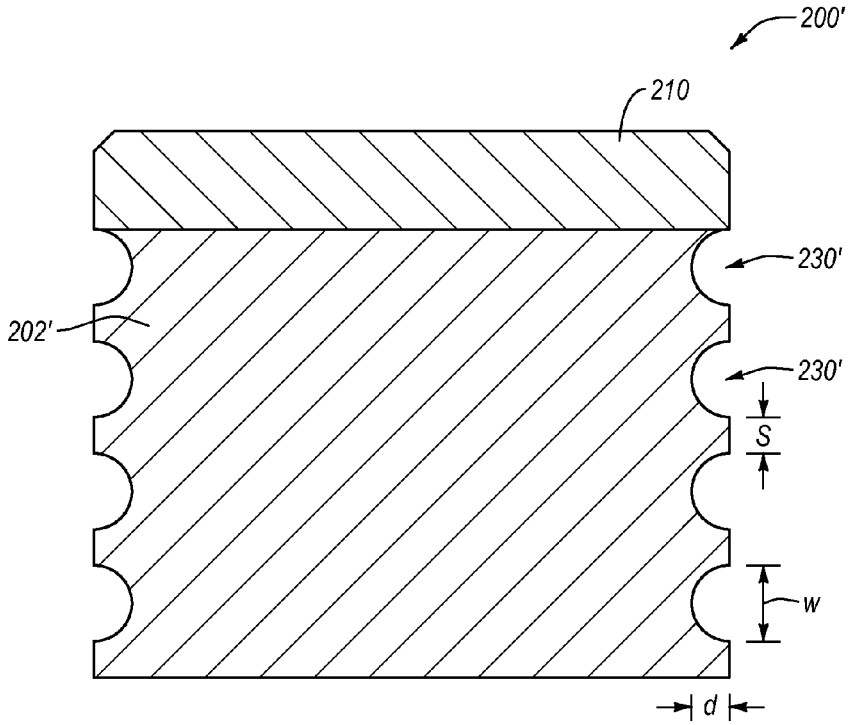
FIG. 3B is a cross-sectional view a superabrasive compact including a superabrasive table bonded to a substrate, with the substrate including a plurality of grooves according to an embodiment.

Other groove and substrate configurations may be employed besides the groove and substrate configuration shown in FIG. 3A. For example, as shown in FIG. 3B, in another embodiment, a superabrasive compact 200' includes a substrate 202' bonded to the superabrasive table 210. The substrate 202' may include a plurality of grooves 230' that are spaced from each other a groove spacing "S," and exhibit a groove depth "d" and groove width "w." For example, the groove spacing "S" may be about 0.0010 inch to about 0.040 inch, about 0.0020 inch to about 0.0080 inch, about 0.0030 inch to about 0.0050 inch, about 0.010 inch to about 0.050 inch, about 0.020 inch to about 0.040 inch, or about 0.030 inch to about 0.045 inch; the groove depth "d" may be about 0.0050 inch to about 0.050 inch, about 0.0050 inch to about 0.0080 inch, about 0.010 inch to about 0.045 inch, about 0.020 inch to about 0.040 inch; and the groove width "w" may be about 0.0050 inch to about 0.050 inch, about 0.0050 inch to about 0.010 inch, about 0.010 inch to about 0.045 inch, or about 0.020 inch to about 0.040 inch.

Figure 3C:
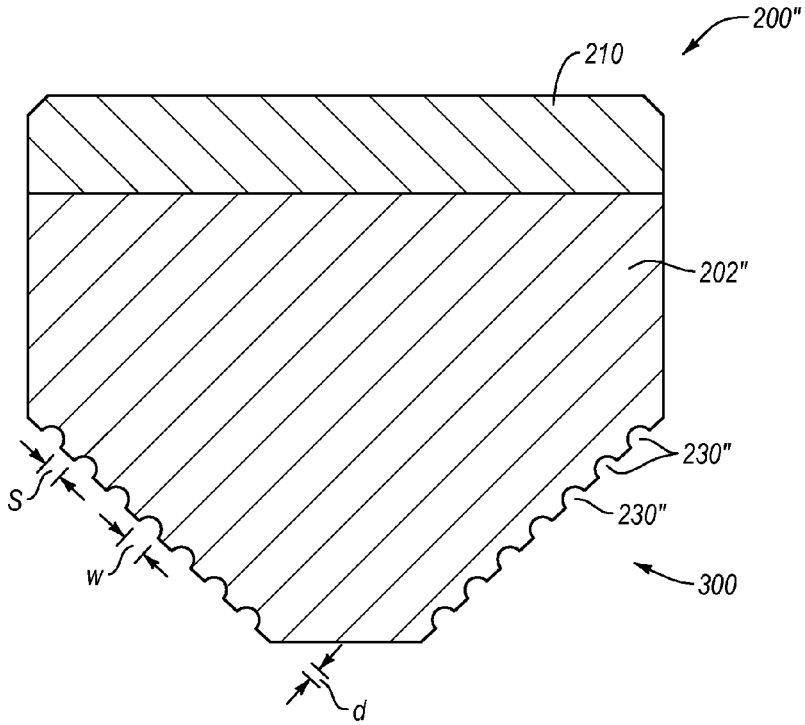
FIG. 3C is a cross-sectional view a superabrasive compact including a superabrasive table bonded to a substrate having a tapered section with a plurality of grooves according to an embodiment.

Referring to FIG. 3C, in other embodiments, a superabrasive compact 200" may include a substrate 202" bonded to the superabrasive table 210. The substrate 202" may include a tapered section 300 having a plurality of grooves 230". The grooves 230" may exhibit any of the groove spacings "S," groove depths "d," and groove widths "w" described above with respect to the superabrasive compact 200' shown in FIG. 3B.

The multiple grooves 230', 230" formed in the substrates 202', 202" in the superabrasive compacts 200', 200" may also help with forming a stronger braze joint between the substrates 202', 202" and a bit body. This is believed to be due to the increased surface area of the grooves 230', 230" as well as mechanical-type locking between the grooves 230', 230" and the braze alloy. The multiple grooves 230', 230" may also help reduce drilling mud from sticking to the superabrasive compacts 200', 200" during drilling because of turbulent flow of the drilling mud caused by the grooves 230', 230".

Turning again to FIG. 3A, following the machining or other process used to form the groove 230, the superabrasive compact 200 may be used in a manner similar to that of superabrasive compact 100 of FIG. 2A. By way of illustration, the superabrasive compact 200 may be brazed using a braze alloy and secured to a drill bit body, although the superabrasive compact 200 may also be used in any other desired manner, including in connection with machining equipment, bearing apparatuses, wire-drawing machinery, molding equipment, and in other mechanical apparatuses. Even when the braze alloy includes a metal or alloy likely to contribute to LME, the modified stress state at the outer-most portions of the substrate 202 may eliminate LME or reduce the susceptibility of the superabrasive compact 200 to LME. In particular, the stress state may be modified to reduce the size of the region 211 of residual tensile stresses by such region being concentrated at the interior of the substrate 202. The outer-most portion of the substrate 202 may thus lack sufficient residual tensile stresses such that wetting of the exterior by a braze alloy may have no effect, or a marginal effect, as to wetting of the region 211 of residual tensile stresses by the braze alloy. Accordingly, in at least one embodiment, the groove 230 may be used to define at least a portion of the at least one LME-susceptibility-reducing feature. The groove 230, however formed, may be left wholly or partially unfilled while the superabrasive compact 200 is then brazed or otherwise secured to a drill bit or other mechanism. In an embodiment in which the groove 230 is wholly or partially unfilled, the superabrasive table 210 may be oversized relative to the grooved portion of the substrate 202, which may also provide a self-sharpening edge as described hereafter.

Figure 4:
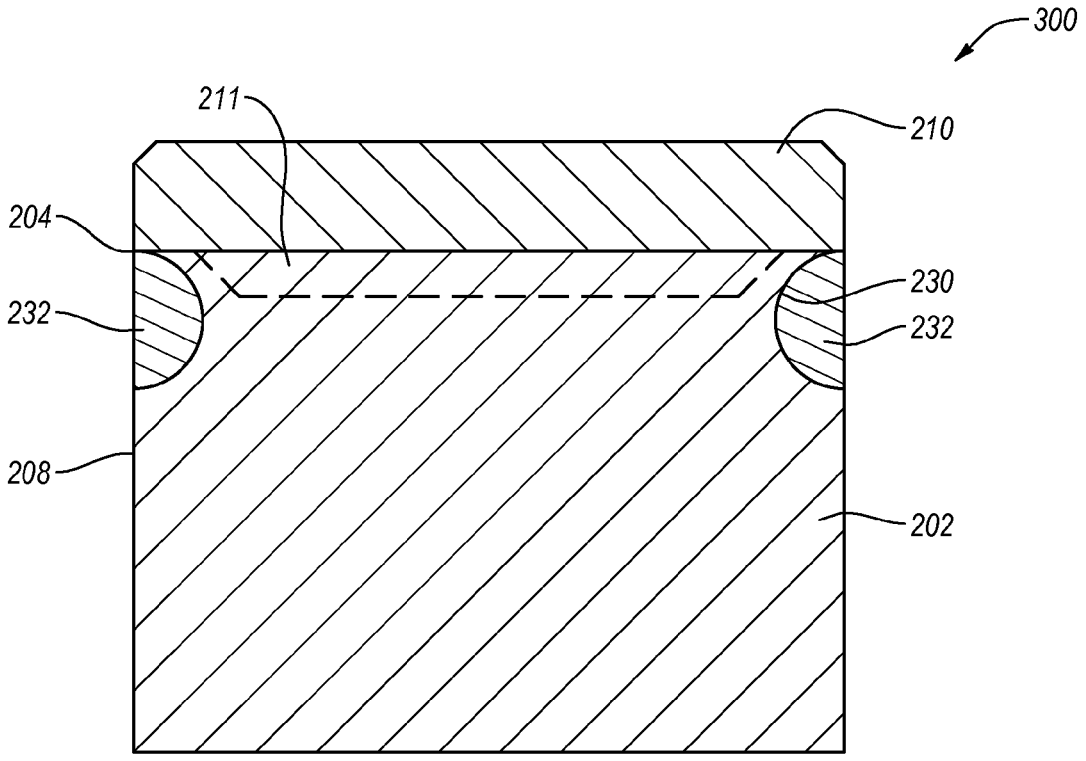
FIG. 4 is a cross-sectional view of the superabrasive compact including a groove filled with a filler material to improve resistance of the substrate to liquid metal embrittlement according to an embodiment.

In another embodiment, and as best illustrated by the cross-sectional view of a superabrasive compact 300 in FIG. 4, the groove 230 or other structure may also be filled with one or more materials. The annular groove 230 may be formed adjacent to the interfacial surface 204 of the substrate 202, and creates a pocket or void. In this embodiment, however, rather than leaving the pocket or void empty or unfilled, a filler 232 has been placed within the groove 230. In some embodiments, the filler 232 may also cover a portion of the exterior peripheral side surface 208 of the substrate 202. The filler 232 may alone or in concert with the groove 230 act as at least a portion of the at least one LME-susceptibility-reducing feature.

For instance, in accordance with some embodiments, the filler 232 may be a non-wettable material relative to a braze alloy. In other words, the filler 232 may not be susceptible to wetting by a braze alloy during a brazing process. Example non-wetting materials may include ceramic materials, curable pastes, glasses, graphite, a thermal sprayed material, combinations of the foregoing, or any other suitable materials. As a non-limiting example, the filler 232 may be chosen from a number of different pastes, which are commercially available from Aremco Products of Valley Cottage, N.Y. One specific commercially available paste is Pyro-Putty® 2400, which comprises a mixture of sodium silicate and stainless steel. Another specific commercially available paste is Pyro-Putty® 950. These types of pastes may at least partially fill the annular groove 230 and the superabrasive compact 300 heated to at least partially cure the paste disposed in the annular groove 230.

In some embodiments, the filler 232 may exhibit a lower coefficient of thermal expansion than that of the substrate 202. For example, the filler 232 may comprise tungsten or a tungsten alloy that is deposited in the groove 230 via chemical vapor deposition, physical vapor deposition, thermal spraying, or other suitable technique and when the filler 232 cools it may help prevent bowing/bending of the superabrasive table 210.

Alternatively, the filler 232 may include a wettable material. For instance, in another embodiment, the filler 232 may include tungsten carbide hard facing. Hard facing or other material may be deposited by deposition (e.g., chemical vapor deposition, physical vapor deposition, thermal spray, or the like) or in manner similar to a weld joint. However, the placement of the filler 232 may be performed without sintering or other bonding process that tends to create high residual tensile stresses between the filler 232 and the superabrasive table 210. Thus, residual tensile stresses between the superabrasive table 210 and the tungsten carbide hard facing or other filler 232 may be much lower than residual tensile stress region 211 in the substrate 202 and the superabrasive table 210. In other embodiments, the filler 232 may include other wettable materials and/or be placed within all or a portion of the groove 230 using any number of other mechanisms.

Regardless of whether the filler 232 includes a wettable or non-wettable material, the filler 232 may act to prevent or limit LME. This may be particularly the case when, for example, the filler 232 extends around all or substantially all of the perimeter of the substrate 202. In such an embodiment, the region 211 of relatively high residual tensile stresses may be concentrated at the interior of the substrate 202. Brazing or other process may then be performed and the filler 232, which may be at the exterior of the substrate 202, may generally prevent or reduce the wetting of the substrate 202 where LME is believed to most likely occur, namely at or adjacent to the region 211. Moreover, regardless of whether the filler 232 includes wettable or non-wettable materials, the risk of LME may be reduced by substantially eliminating any wetting of the region 211. In the case where the filler 232 includes a wettable material, the chance of LME is reduced by wetting the filler 232 rather than the region 211 of the substrate 202. Thus, braze alloy wets the material that does not necessarily have relatively high residual tensile stresses present therein.

As will be appreciated by one skilled in the art in view of the disclosure herein, "wetting" or "wettability" may generally be referred to as a measure of the degree to which a liquid is able to maintain contact with a solid surface. Wettability may generally be measured by reference to the contact angle existing between a liquid-vapor interface and a solid-liquid interface, which contact angle results from balancing adhesive forces between the liquid and solid with the cohesive forces within the liquid. In general, a contact angle of zero is considered to be perfect wetting, while materials with a contact angle between zero and ninety degrees have high wettability.

Accordingly, one skilled in the art will further appreciate that a "non-wettable" material or component may include any number of materials, and that "non-wetting" may refer to materials having varying degrees of wetting relative to a selected wetting agent, such as braze alloy. For instance, materials defining a contact angle of one-hundred eighty degrees may be considered to be perfectly non-wetting, while materials having a contact angle between ninety and one-hundred eighty degrees may generally be considered to have low wettability.

While FIGS. 3A and 4 illustrate the groove 230 being radiused with an upper edge terminating the interfacial surface 204 of the substrate, it should be appreciated that the groove 230 is merely for illustrative purposes and is not intended to limit the scope of the present disclosure. In particular, in other embodiments, an upper edge of the groove 230 may be offset a distance axially from the interfacial surface 204. For instance, the upper edge of the groove 230 may be positioned between about 0.005 mm and about 2.0 mm from the interfacial surface 204, although the offset distance may be more or less in other embodiments. Moreover, while the groove 230 may be wholly within the substrate 202, in other embodiments the groove 230 is at least partially formed within the superabrasive table 210.

Moreover, while the annular groove 230 has a radius or otherwise curved configuration, this too is merely an illustrated. The groove 230, thus, need not be formed to have a semi-circular or even arcuate cross-sectional shape within the side surface 208 of the substrate 202. In other embodiments, for instance, a groove may be formed having a rectangular, triangular, parabolic, or other suitable configuration. Further, while the illustrated groove 230 extends along an axis that extends generally parallel to the interfacial surface 204, in other embodiments, the groove 230 may be inclined, or have various segments set at an incline, relative to the interfacial surface 204. Thus, as used herein, the term "groove" should not be construed as requiring any particular shape or configuration, but is intended to broadly encompass cuts, slots, or other features that create a pocket or other void that is accessible from the exterior of the superabrasive compact 300. Accordingly, while the groove 230 of FIGS. 3A and 4 is described above in the context of a groove formed by a grinding or machining process following the formation of a superabrasive compact using an HPHT sintering or other process, in other embodiments the groove 230 may be integrally formed within the superabrasive compact as part of an HPHT sintering, pressing, or other process.

Figure 5:
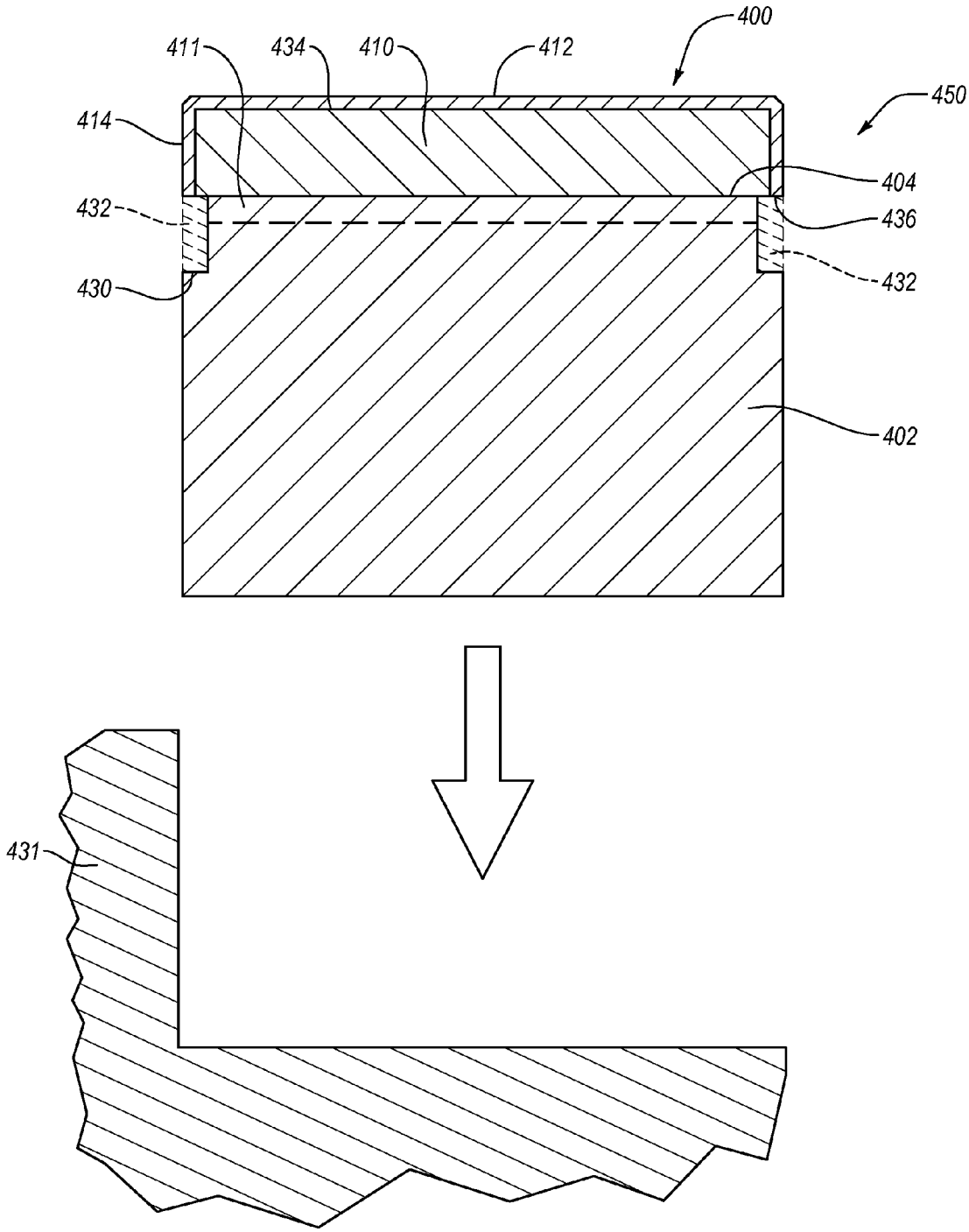
FIG. 5 is an exploded cross-sectional view of a cutting assembly including a superabrasive compact securable within a cutter recess of a drill bit body according to an embodiment.

For instance, FIG. 5 illustrates an exploded cross-sectional view of a cutting assembly 450 including a superabrasive compact 400 that includes a superabrasive table 410 bonded to a substrate 402, along with an optional filler 432 bonded to the substrate 402. The superabrasive table 410 and substrate 402 may be made from any of the previously discussed materials for the superabrasive table 110 and the substrate 102. More particularly, the filler 432 may be located within a void or pocket defined by a groove 430 and may be bonded to the substrate 402 and/or the superabrasive table 410 by a pressing, sintering, or other process. For instance, the filler 432 may be sintered or otherwise bonded to the superabrasive table 410 during the same HPHT process in which the superabrasive table 410 is bonded to the substrate 402. Alternatively, the filler 432 may be bonded to the substrate 402 and/or the superabrasive table 410 during a pressing, sintering (e.g., HPHT sintering), or other process performed subsequent to a process used to bond the substrate 402 to the superabrasive table 410.

In accordance with one embodiment, the filler 432 of FIG. 5 is a graphite material. For instance, the filler 432 may, in some embodiments, include a laminated graphite material. An example laminated graphite material suitable for use in the disclosed embodiments includes graphite materials known as Grafoil®, which is currently available from GrafTech International of Lakewood, Ohio. In accordance with one embodiment, the laminated graphite or other material may be placed adjacent to the substrate 402 and superabrasive table 410 as shown in FIG. 5. In some embodiments, the laminated graphite or other material 432 is a band. Such band may be sized to fit within the groove 420, or may have a size larger than the size of the substrate 402 and/or superabrasive table 410. During the sintering or other bonding process, the laminated graphite or other material may shrink, thereby shrinking to fit and to bond to the superabrasive table 410 and/or the substrate 402. In some embodiments, a laminated graphite material may undergo HPHT sintering. The high pressure and high temperature may cause the laminated graphite to convert to low-quality diamond during sintering.

Following forming of the superabrasive table 410 illustrated in FIG. 5, the superabrasive compact 400 may be secured within a receptacle 431. The receptacle 431 may be formed of a metal, alloy, an infiltrated carbide material, or combinations thereof. The receptacle 431 may be connected to, or integral within, a drill bit body. However, the superabrasive compact 400 may be secured to any other suitable location, pocket, receptacle, or device. Securing of the superabrasive compact 400 within the receptacle 431 may be performed in any suitable manner. For instance, the superabrasive compact 400 may be brazed as described herein. In other embodiments, other attachment or other bonding mechanisms or processes may be utilized.

In an embodiment in which the superabrasive compact 400 is brazed to the receptacle 431, a braze alloy (not shown) may be heated and flow between the superabrasive compact 400 and the receptacle 431. As the braze alloy flows, it may wet at least a portion of the surface of the superabrasive compact 400. By way of illustration, in an embodiment in which the substrate 402 is a cemented carbide and the filler 432 is laminated graphite, a braze alloy may wet the cemented carbide. The laminated graphite may, however, have a relatively low wettability relative to the braze alloy. Consequently, only the exterior surface of the cemented carbide may be significantly wetted. The laminated graphite and/or low-quality diamond may substantially keep the braze alloy from significantly wetting a region 411 of relatively high residual tensile stresses that is adjacent to an interfacial surface 404 of the substrate 402. Accordingly, the risk of LME may be reduced.

FIG. 5 further illustrates an embodiment in which the superabrasive table 410 may be leached. More particularly, as described above with respect to FIGS. 1A *and* 1B, the superabrasive table 410 may be leached to deplete a metal-solvent catalyst or a metallic infiltrant therefrom and to thereby enhance the thermal stability of the superabrasive table 410. An example is the removal of at least a portion of a metal-solvent catalyst or a metallic infiltrant used to initially sinter diamond grains of the superabrasive table 410 or a metallic infiltrant. For example, as the metal-solvent catalyst is removed, a thermally-stable region 434 may be formed. As shown in FIG. 5, the thermally-stable region 434 may extend inwardly from upper surface 412 and side surface 414 of superabrasive table 410.

In some embodiments, the superabrasive table 410 is leached along the full height of the superabrasive table 410. An example of such is illustrated in FIG. 5, in which the thermally-stable region 434 extends along the full height of the peripheral side surface 414 terminating at the filler 432 which may serve as a leach stop to prevent exposure of the substrate 402 to a leaching acid. The height of the side surface 414 generally corresponds to the thickness of the superabrasive table 410.

Leaching the superabrasive table 410 is optional, and when performed may be performed in the presence or absence of the filler 432. In one embodiment, leaching may therefore be performed while the filler 432 is intact within the groove 430. Moreover, leaching may be performed against the filler 432 itself.

It may also be undesirable in some circumstances to leach portions of the substrate 402. For instance, if leaching is performed on the substrate 402 at or near the interfacial surface 404, leaching may remove metal-solvent catalyst or a metallic infiltrant and weaken the bond between the substrate 402 and the superabrasive table 410. Accordingly, to avoid such, a portion of the substrate 402 and/or the superabrasive table 410 may be masked off or otherwise prevented from allowing a leaching agent to contact the substrate 402 near the interfacial surface 402. However, where the filler 432 is present, the filler 432 may be located at the exterior of the superabrasive compact 400, such that near the interfacial surface 404, the leaching agent contacts the filler 432 rather than the substrate 402. In other embodiments, the substrate 402 may be exposed to a leaching agent.

In the illustrated embodiment, the filler 432 is shown in phantom lines to indicate that the filler 432 may remain in place during use in the cutting assembly 450, or may be removed therefrom. Thus, while the filler 432 may remain in place during a brazing process or other process during which the superabrasive compact 400 is secured to the receptacle 431, the filler 432 may also be removed. For instance, a grinding, grit blasting, or other machining process may be employed to remove the filler 432. Once the filler 432 is removed, the groove 430 may be filled with still another filler material, such as those disclosed herein, or may remain unfilled.

Considering an embodiment in which the filler 432 includes a laminated graphite or other material that is removed from the groove 430, the removal of the filler 432 may also allow the superabrasive compact 400 to remain resistant to LME. For instance, as a laminated graphite material is removed, one or more surfaces within the groove 430 may be exposed. Due to such surfaces having been in contact with laminated graphite, the exposed surfaces may be highly graphitized or carburized, which may make such surfaces resistant to wetting from a desired braze alloy. As the exposed surfaces may be at or near the region 411 where residual tensile stresses may exist, such resistance to wetting may also make the superabrasive compact 400 LME resistant.

In accordance with another embodiment, removal of the filler 432 in the cutting assembly 450 may allow cutting assembly 450 to have a self-sharpening edge. More particularly, if the filler 432 is removed, the groove 430 may remain empty, such that the superabrasive table 410 is oversized relative to the adjacent portion of the substrate 402. The superabrasive table 410 may thus overhang the substrate 402 so that that a lower edge 436 is exposed at the open portion of the groove 430. The open lower edge 436 facilitates the self-sharpening aspects of the illustrated embodiment. Moreover, the open lower edge 436 may reduce heat build-up due to contact between the substrate 402 and an earth formation or other element being cut. Heat build-up may degrade the superabrasive compact 400. Consequently, reducing heat build-up may extend the useful life of the superabrasive compact 400.

Figure 6:
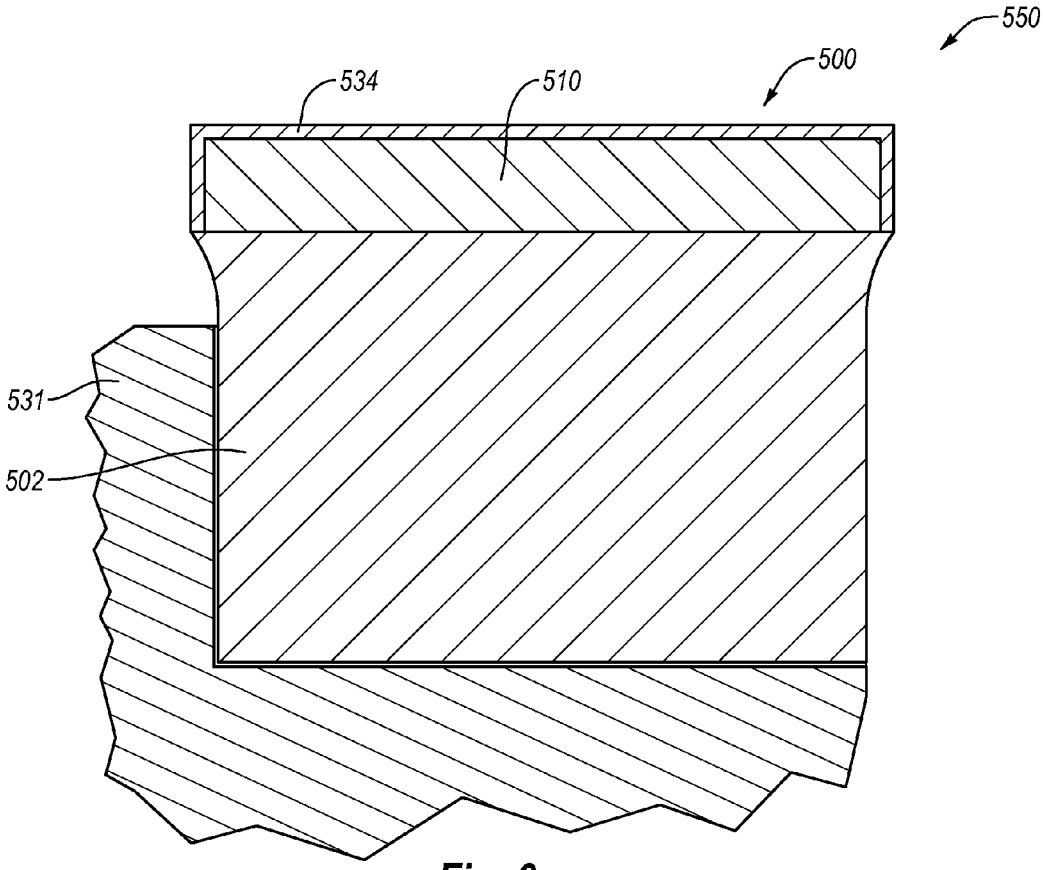
FIG. 6 is a cross-sectional view of a cutting assembly including a self-sharpening superabrasive compact secured within a cutter recess of a drill bit body according to an embodiment.

FIG. 6 illustrates another embodiment of a cutting assembly 550 in which a superabrasive compact 500 has a self-sharpening edge and is secured within a receptacle 531. The receptacle 531 is merely illustrative of a receptacle that may be used in connection with a drill bit, cutting tool, leaching cup, or other mechanical apparatus.

The superabrasive compact 500 may be similar to the superabrasive compact 400 illustrated and described with respect to FIG. 5. For instance, the superabrasive compact 500 may include substrate 502 that has a portion at least partially removed (e.g., by a grinding, machining, or other process) or formed with an undersized substrate 502 such that the superabrasive table 510 is at least slightly oversized to provide a self-sharpening edge. The superabrasive table 510 and substrate 502 may be made from any of the previously discussed materials for the superabrasive table 110 and the substrate 102. The removed material from the substrate 502 also allows for leaching down the full side of the superabrasive table 510 in the formation of the thermally-stable region 534 of the superabrasive table 510.

However, in contrast with other embodiments herein, the superabrasive compact 500 of FIG. 6 includes a substrate 502 having a reduced width through all or a substantial portion of the thickness of the substrate 502. In other words, the superabrasive table 510 may be have a lateral dimension (e.g., a diameter) sized larger than all or a substantial portion of the substrate 502. In one embodiment, the substrate 502 is formed in a manner similar to that described above. For instance, a filler (not shown) may be formed within the superabrasive compact 502 and then removed. Thereafter, the remainder of the substrate 502 may be ground, machined, or otherwise formed down to a desired size. In another embodiment, no filler may be used. Instead, the substrate 502 may be initially formed to have a width generally similar to the width of the superabrasive table 510. All or a portion of the substrate 502 may then be ground, machined, or otherwise formed down to the desired size. In FIG. 6, the substrate 502 may gradually taper from a lateral dimension substantially equal to that of the superabrasive table 510 to a reduced lateral dimension. In other embodiments, the lateral dimension of the superabrasive table 510 may abruptly change, or may be reduced along a full thickness of the substrate 502. In forming the substrate 502 to have a reduced lateral dimension, the superabrasive table 510 may not only be provided with a self-sharpening edge, but an LME prone region just below the superabrasive table 510 may have its stress-state modified to reduce the residual tensile stresses, which may, in certain situations, make such area less susceptible to LME.

Figure 7:
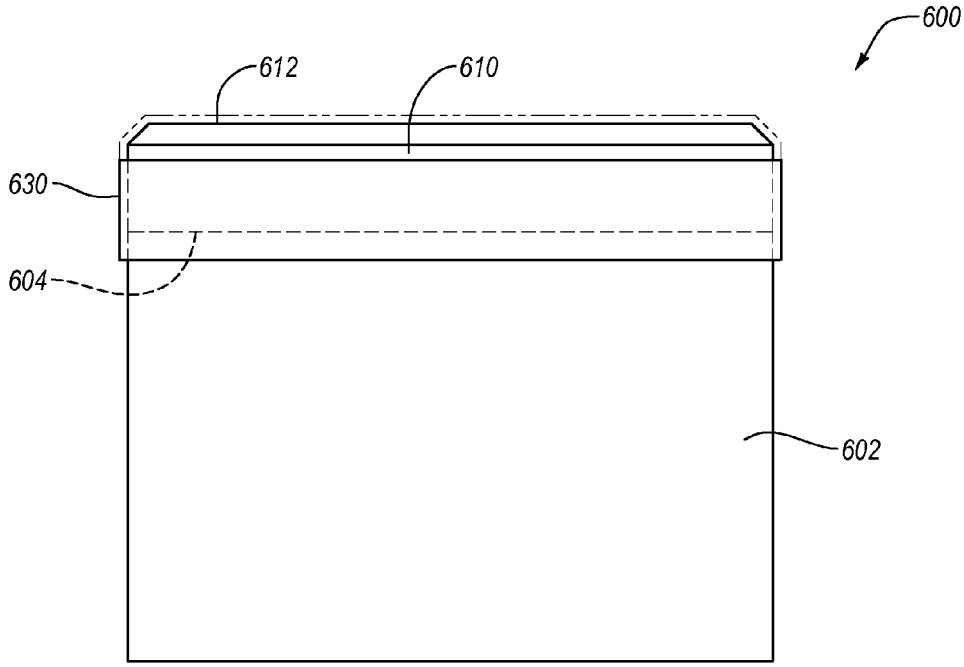
FIG. 7 is an isometric view of a superabrasive compact including a superabrasive table bonded to a substrate, with a protective material on an exterior surface of the substrate and adjacent to the superabrasive table to limit wetting of the substrate and reduce susceptibility thereof to LME according to an embodiment.

Turning now to FIG. 7, another embodiment of a superabrasive compact 600 is illustrated. The superabrasive compact 600 may also be configured to be LME resistant. In particular, the superabrasive compact 600 of the illustrated embodiment includes a substrate 602 bonded to a superabrasive table 610. The superabrasive table 610 and substrate 602 may be made from any of the previously discussed materials for the superabrasive table 110 and the substrate 102. In this particular embodiment, an external protective material 630 is placed on at least a portion of the superabrasive compact 600. For instance, the external protective material 630 may be located on at least a portion of the substrate 602 and/or may also be on a portion of the superabrasive table 610.

More particularly, in FIG. 7, the substrate 602 may have a width that is substantially the same as the width of the superabrasive table 610. In this embodiment, the protective material 630 is shown as a coating or band extending around the peripheral surfaces of the substrate 602 and superabrasive table 610. The protective material 630 has a thickness which increases the overall width of the superabrasive compact 600 at the location at which the protective material 630 is applied.

In general, the protective material 630 may be used to prevent wetting of a region of the substrate 602 that is near interfacial surface 604, and which has relatively high residual tensile stresses and is potentially susceptible to LME when wetted by a braze alloy or other liquid metal. The thickness of the protective material 630 may vary to accommodate such purpose, or to otherwise facilitate application of the protective material 630 to the substrate 602 and/or superabrasive table 610.

As illustrated in FIG. 7, the protective material 630 may overlap the interfacial surface 604 and covers an exterior portion of both the substrate 602 and the superabrasive table 610. It should be appreciated that such an embodiment is merely illustrative and that the portion of the substrate 602 and/or superabrasive table 610 to which the protective material 630 is applied may vary. For instance, in other embodiments, the protective material 630 may be applied directly to the substrate 602 and may not substantially coat, cover, overlap, or enclose any portion of the superabrasive table 610. In other embodiments, the superabrasive table 610 may be partially or wholly covered. For instance, as illustrated in phantom lines, in at least one embodiment, the protective material 630 may enclose the top surface 612 of the superabrasive table 610, and thus enclose substantially the full exterior of the superabrasive table 610. A protective material may be applied or otherwise secured or placed on the substrate 602 and/or superabrasive table 610 in any suitable manner. For instance, the protective material 630 may be a coating or other material that can be applied to the exterior surface of the substrate 602 and/or the superabrasive table 610 by a painting, dipping, deposition, or other process. The protective material 630 may also be a coating or other material that is attached, mounted, adhered, or otherwise placed on all or a portion of the substrate 602 or the superabrasive table 610 in any other suitable manner. Accordingly, the protective material 630 may be provided in the form of a sleeve or a cap, or applied to the substrate 602 and/or superabrasive table 610 in such form. In still other embodiments, the protective material 630 may be positioned in other manners, such as a spot application.

The protective material 630 may thus be structured in a number of different manners. For instance, the protective material 630 may, in some embodiments, coat or otherwise at least partially cover a region of the substrate 602 that is prone to having relatively high residual tensile stresses and, thus, likely to exhibit certain conditions making the substrate 602 potentially susceptible to LME. Such region may vary in size. For instance, a residual tensile stress region may exist extend between 0.0005 mm and 0.5 mm along the length of the substrate 602, starting approximately at the interfacial surface 604. In such an embodiment, the protective material 630 may be applied to the substrate 602 so that the protective material 630 encompasses a sufficient portion of the substrate 602 in order that a majority of the residual tensile stress region is enclosed within the protective material 630. As a result, in a subsequent brazing process or other process which causes a liquid metal to flow over the substrate 602, the protective material 630 may restrict the liquid metal from wetting the substrate 602 at the region of relatively high residual tensile stresses. Instead, the protective material 630 may be non-wettable, or may be wettable but may lack the residual tensile stresses that are believed to contribute to LME.

The protective material 630 may in some embodiments be used to contribute to prevention of LME in the superabrasive compact 600. The protective material 630 may also have additional or other functions or purposes. For instance, the protective material 630 may cover all or a portion of the superabrasive table 610 while the superabrasive compact 600 is brazed or otherwise secured to a drill bit, cutter, bearing, or other object or assembly. The protective material 630 may provide a thermal or other barrier reducing a risk of a direct flame or other heat inadvertently damaging the superabrasive table 610. In still other embodiments, multiple superabrasive compacts 600 may be secured to a drill bit or other object. A compact near one being repaired or replaced may have a protective material 630 that shrouds all or a portion of a corresponding superabrasive compact 600. In some cases, the protective material 630 may thus be positioned after the superabrasive compact has been secured in a drill bit or other object. Such a protective material 630 may thus act as a shield or cover to withstand the pre-heat of induction or oven heating. In some cases, the protective material 630 may also facilitate obtaining oxygen to protect the superabrasive compact 600 from effects of oxidation or corrosion from the atmosphere or flux.

Further, direct contact between a superabrasive table 610 and a drill bit or other object may be undesirable under some conditions. In such cases, the protective material 630 may be formed as a cap or band around all or a portion of the superabrasive table 610. In such a manner, the superabrasive table 610 may act as a spacer or cushion between a drill bit or other object do reduce direct contact between such an object and the superabrasive table 610. In some cases, a protective material (e.g., hardfacing) may be placed over and around the superabrasive compact 600, potentially without making direct contact with the superabrasive table 610. The protective material may build up within or near a receptacle or pocket in which the superabrasive compact 610 is secured. The protective material may then spill out onto the exposed surface of the substrate 602, thereby protecting at least a portion of the substrate 602.

Any suitable material may thus be used for protective material 630 so as to reduce or eliminate LME from occurring in the superabrasive compact 600. For instance, in some embodiments, braze stop-off may be applied as the protective material 630. Braze stop-off may prevent the flow of flux and metal to unwanted areas during a brazing process. Alternatively or additionally, the protective material may include titanium nitride that is applied as a coating via physical or chemical vapor deposition, hexagonal boron nitride, ceramic coatings, shrink-fit material bands, paint, graphite or other tape, thermal sprays, compacted pieces of weaves or felts, pre-forms, other materials, machined solids, or combinations of the foregoing. Such materials may be applied using a deposition process, an aerosol spray, an adhesive, or other application process, including before, during, or after attachment of the superabrasive compact 600 within a receptacle. Examples of suitable protective materials may include Stop-Flo™ stop-off paint, paste, or tape, which is commercially available from Johnson Matthey of Hertfordshire, United Kingdom. Still other suitable materials may include Nicrobraz flux, cements, or stop-off materials, such as may be available from Wall Colmonoy Corporation of Madison Heights, Mich. Additional materials that may be applied as the protective material 630 also include OMNI 460 Stop-Off and OMNI 470 Stop-Off, each of which are available from Lucas-Milhaput, Inc. of Cudahy, Wis. Another example of a suitable material for the protective material 630 may include a boron-nitride stop-off spray or paste, an example of which is available from ZYP Coatings, Inc. of Oak Ridge, Tenn. The foregoing materials are presented merely to illustrate that a range of different types of materials and compositions may be used, in whole or in part, to form the protective material 630. Accordingly, still other materials may also be applied to the superabrasive compact 600 as a protective layer such as the protective material 630. Depending upon the type of material from which the protective material 630 is made, the protective material 630 may also be applied during or after an HPHT or other press process used to bond the substrate 602 to the superabrasive table 610. For instance, as described above, a protective material (e.g., low-quality diamond converted from laminated graphite and/or graphite) may be formed as part of a superabrasive compact during an HPHT process. In such a process, the graphite material (e.g., graphite powder and/or grafoil) may be placed within a groove and subjected to an HPHT process to form the superabrasive compact and convert the protective material to low-quality diamond and/or solid graphite. However, in other embodiments the protective material may form a band wholly or partially external to the substrate 602 and/or the superabrasive table 610. In other embodiments, the substrate 602 may be bonded to the superabrasive table 610 in a first process (e.g., HPHT sintering) and the protective material 630 may be applied to the finished compact after the press or other bonding process Regardless of the type of material or manner of application, the protective material 630 may have any number of other properties. For instance, in one embodiment, the protective material 630 may be a sacrificial element. By way of illustration, the protective material 630 may remain in place on the substrate 602 and/or superabrasive table 610 during or after a brazing process, repair to a nearby compact, or during heating of the compact. After any such process has been completed, the protective material 630 may be removed in a suitable manner. For instance, the protective material 630 may be machined off or may be removed by blasting off the protective material 630. In other embodiments, the protective material 630 remains in place temporarily, but as the superabrasive table 610 is used (e.g., in a cutting assembly) the wear-and-tear to which the compact 600 is subject may wear down and potentially cause the protective material 630 to slough off. The rate at which the protective material 630 is removed may vary. For instance, if the protective material 630 is applied to the superabrasive table 610 and the superabrasive table 610 is used as a cutting element, the protective material 630 may have a hardness less than an earthen formation or other to-be-cut element, so as to wear the protective material 630 away fairly rapidly. Indeed, in such embodiments, even where the substrate 602 has the protective material 630 thereon, the cut material may rub against the protective material 630 on the substrate 602 and rapidly remove the protective material 630 from the substrate 602.

In other embodiments the protective material 630 may be more durable in nature. For instance, the protective material 630 may include a superhard material such as tungsten carbide that is formed or deposited on the substrate 602 and/or superabrasive table 610. The material may be sufficiently hard to wear away slowly, or have a thickness that prevents rapid wear.

Figure 8A:
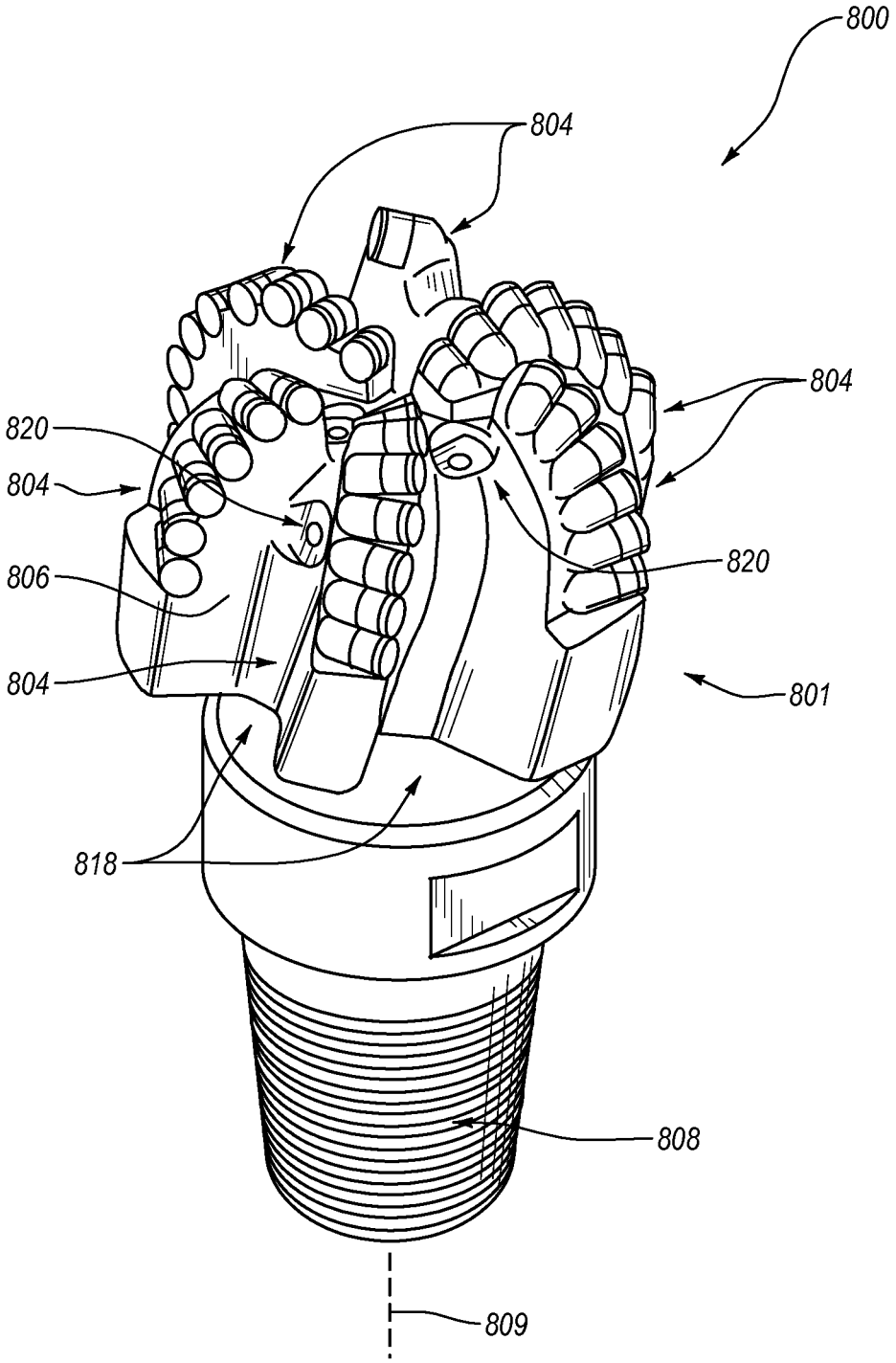
FIG. 8A is an isometric view of a drill bit including one or more of the disclosed superabrasive compacts according to an embodiment.
Figure 8B:
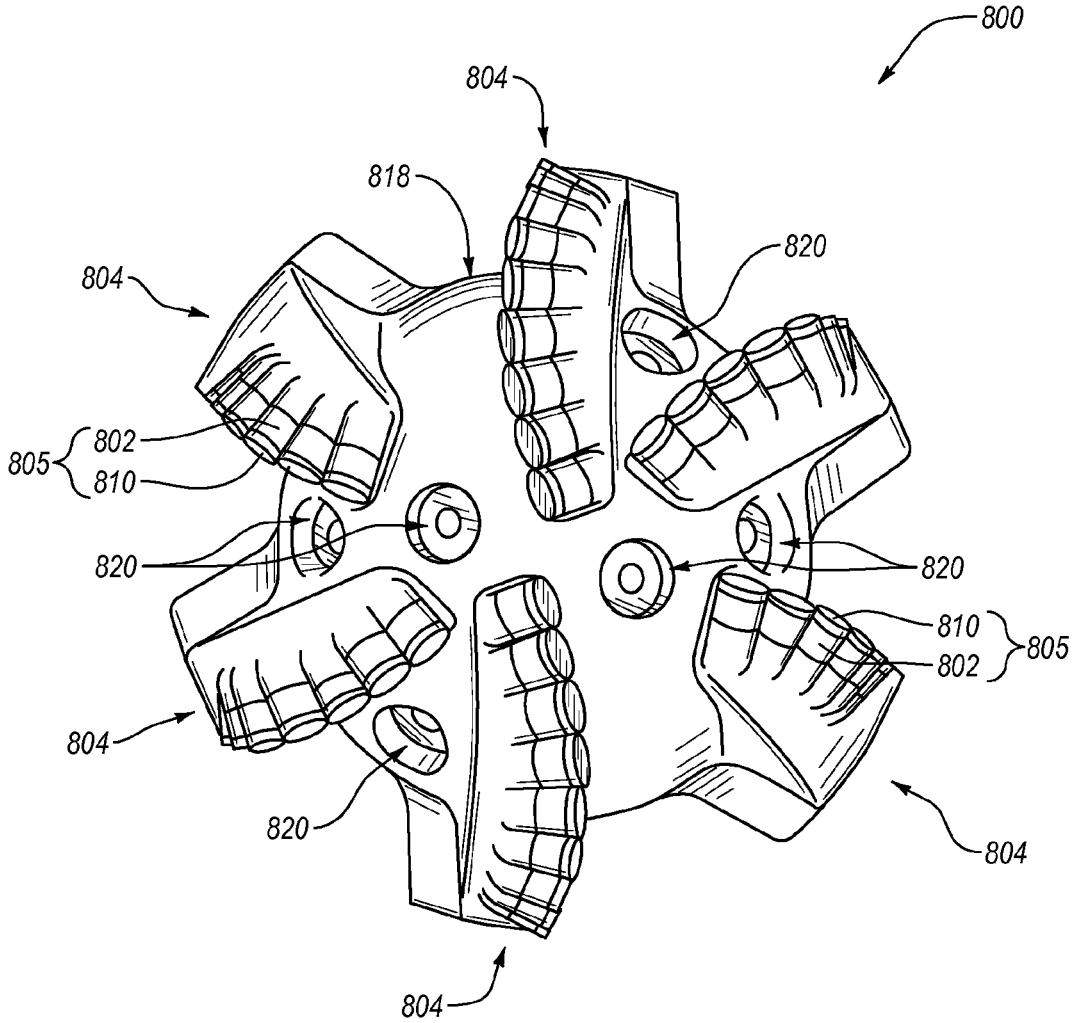
FIG. 8B is a top plan view of the drill bit shown in FIG. 8A.

Referring to FIGS. 8A and 8B, a superabrasive compact according to any of the foregoing embodiments may be used in a variety of applications, such as rotary drill bits. FIG. 8A is an isometric view and FIG. 8B is a top elevation view of an embodiment of a rotary drill bit 800. The rotary drill bit 800 includes at least one superabrasive compact, such as a PDC, which may be usable as a superabrasive cutting element 805 and configured according to any of the previously described methods. The rotary drill bit 800 comprises a bit body 801 that includes radially-extending and longitudinally-extending blades 804 with leading faces 806, and a threaded pin connection 808 for connecting the bit body 801 to a drilling string. The bit body 801 defines a leading end structure for drilling into a subterranean formation by rotation about a longitudinal axis 809 and application of weight-on-bit.

At least one superabrasive cutting element 805 configured according to any of the previously described superabrasive compact embodiments (e.g., the superabrasive compact shown in FIGS. 3A-7), may be affixed to the bit body 801. According to some embodiments herein, the at least one superabrasive cutting element 805 is disposed within a corresponding recess formed in the bit body 801. For example, recesses may be blind holes, pockets, or another suitable receptacle formed in the bit body 801, and the substrate portion of the superabrasive cutting elements 805 may be sized to generally correspond to the size the recesses. With reference to FIG. 8B, each of a plurality of cutting elements 805 is disposed within a corresponding one of the recesses of the blades 804.

More particularly, the rotary drill bit 800 shown in FIGS. 8A and 8B may be fabricated by positioning the superabrasive cutting elements 805 in a corresponding one of the recesses formed in the bit body 801, followed by subjecting the bit body 801, the superabrasive cutting elements 805, and braze alloy to a suitable braze processes that include temperature cycles that melt and cause the braze alloy to flow so that so that a strong metallurgical bond is formed between a substrate 802 of the superabrasive cutting element 805 and the bit body 801 upon cooling. The brazing temperature depends, at least in part, on the liquidus temperature of the braze alloy. For example, typically, the brazing temperature may be about 600° C. to 1050° C., such as about 600° C. to about 750° C.

Each cutting element 805 may include a superabrasive table 810 bonded to the substrate 802. More generally, the cutting elements 805 may comprise any superabrasive compact disclosed herein, without limitation. Accordingly, in some embodiments, the substrate 802, or a region of relatively high residual tensile stress within the substrate 802 and adjacent to an interface with the superabrasive table 810, is substantially prevented from becoming wetted by the flowing braze alloys during the braze processes. In addition, if desired, in some embodiments, a number of the cutting elements 805 may be conventional in construction. Also, circumferentially adjacent blades 804 may define so-called junk slots 818 therebetween, as known in the art. Further, the rotary drill bit 800 may include a plurality of nozzle cavities 820 for communicating drilling fluid from the interior of the rotary drill bit 800 to the cutting elements 805.

FIGS. 8A and 8B merely depict one embodiment of a rotary drill bit 800 that employs at least one cutting element that comprises a superabrasive compact suitable for analysis and fabrication in accordance with the disclosed embodiments, without limitation. The rotary drill bit 800 is used to represent any number of earth-boring tools or drilling tools, including, for example, core bits, roller-cone bits, fixed-cutter bits, eccentric bits, bicenter bits, reamers, reamer wings, or any other downhole tool including superabrasive compacts or PDCs, without limitation.

The superabrasive compacts disclosed herein may also be utilized in applications other than cutting technology. For example, the disclosed superabrasive compact embodiments may be used in wire dies, bearings, artificial joints, inserts, cutting elements, and heat sinks Thus, any of the superabrasive compacts disclosed herein may be employed in an article of manufacture including at least one superabrasive element or compact.

Thus, the embodiments of superabrasive compacts disclosed herein may be used in any apparatus or structure in which at least one conventional PDC is typically used. In one embodiment, a rotor and a stator, assembled to form a thrust-bearing apparatus, may each include one or more superabrasive compacts configured according to any of the embodiments disclosed herein and may be operably assembled to a downhole drilling assembly. U.S. Pat. Nos. 4,410,054; 4,560,014; 5,364,192; 5,368,398; and 5,480,233, the disclosure of each of which is incorporated herein, in its entirety, by this reference, disclose subterranean drilling systems within which bearing apparatuses utilizing superabrasive compacts disclosed herein may be incorporated. The embodiments of superabrasive compacts disclosed herein may also form all or part of heat sinks, wire dies, bearing elements, cutting elements, cutting inserts (e.g., on a roller-cone-type drill bit), machining inserts, or any other article of manufacture as known in the art. Other examples of articles of manufacture that may use any of the superabrasive compacts disclosed herein are disclosed in U.S. Pat. Nos. 4,811,801; 4,268,276; 4,468,138; 4,738,322; 4,913,247; 5,016,718; 5,092,687; 5,120,327; 5,135,061; 5,154,245; 5,180,022; 5,460,233; 5,544,713; and 6,793,681, the disclosure of each of which is incorporated herein, in its entirety, by this reference.

While various aspects and embodiments have been disclosed herein, other aspects and embodiments are contemplated. The various aspects and embodiments disclosed herein are for purposes of illustration and are not intended to be limiting. Additionally, the words "including," "having," and variants thereof (e.g., "includes" and "has") as used herein, including the claims, shall be open ended and have the same meaning as the word "comprising" and variants thereof (e.g., "comprise" and "comprises").

The invention claimed is:

1. A superabrasive compact, comprising:

a superabrasive table;

a substrate including an interfacial surface bonded to the superabrasive table, a base surface, and at least one peripheral surface extending between the base surface and the interfacial surface; and at least one liquid-metal-embrittlement-susceptibility-reducing feature including at least one groove formed in the at least one peripheral surface of the substrate at least proximate to the interfacial surface thereof, the at least one groove of the at least one liquid-metal-embrittlement-susceptibility-reducing feature being at least partially unfilled and being positioned and configured to be exposed to a braze alloy when the substrate is brazed to a body.

2. The superabrasive compact of claim 1, further comprising a filler material disposed within the at least one groove.

3. The superabrasive compact of claim 2 wherein the filler material comprises a substantially non-wettable material.

4. The superabrasive compact of claim 2 wherein the filler material comprises a wettable material.

5. The superabrasive compact of claim 2 wherein the superabrasive table comprises a leached region that extends along the at least one peripheral surface and terminates at the filler material.

6. The superabrasive compact of claim 1 wherein the at least one liquid-metal-embrittlement-susceptibility reducing feature provides a reduction in the residual tensile stresses in the substrate in a residual tensile stress region at least proximate to the interfacial surface compared to if the at least one liquid-metal-embrittlement-susceptibility-reducing feature were absent.

7. The superabrasive compact of claim 1 wherein the at least one liquid-metal-embrittlement-susceptibility-reducing feature provides at least low wettability by the braze alloy at a residual tensile stress region at least proximate to the interfacial surface.

8. The superabrasive compact of claim 1 wherein the at least one liquid-metal-embrittlement-susceptibility-reducing feature comprises a protective material disposed on the at least one peripheral surface of the substrate at least proximate to the interfacial surface thereof, the protective material configured to limit access by a braze alloy to a residual tensile stress region.

9. The superabrasive compact of claim 8 wherein the protective material is a shrink-fit material.

10. The superabrasive compact of claim 8 wherein the protective material comprises braze stop-off, graphite, grafoil, graphite tape, hexagonal boron nitride, a thermal sprayed material, paint, a ceramic, or combinations thereof.

11. The superabrasive compact of claim 8 wherein the protective material is sacrificial relative to the substrate.

12. The superabrasive compact of claim 1 wherein the superabrasive table comprises sintered polycrystalline diamond.

13. A superabrasive compact, comprising:

a superabrasive table including an upper surface, a bonding surface, and a table peripheral surface extending between the upper surface and the bonding surface;

a substrate including an interfacial surface bonded to the superabrasive table, a base surface, and at least one substrate peripheral surface extending between the base surface and the interfacial surface;

at least one groove formed in at least a portion of the table peripheral surface and at least a portion of the substrate peripheral surface; and a filler disposed within at least a portion of the at least one groove.

14. The superabrasive compact of claim 13 wherein the filler is a substantially non-wettable material.

15. The superabrasive compact of claim 13 wherein the filler is a wettable material.

16. The superabrasive compact of claim 13 wherein the superabrasive table comprises a leached region that extends along the at least one table peripheral surface and terminates at the filler.

17. The superabrasive compact of claim 13 wherein the filler comprises a ceramic material, graphite, a thermal sprayed material, hard facing, tungsten carbide, or combinations thereof.

18. The superabrasive compact of claim 13 wherein a residual tensile stress region exists at least proximate to the interfacial surface of the substrate, and wherein the at least one groove includes a surface that is configured to limit wetting thereof by a braze alloy.

19. The superabrasive compact of claim 13 wherein the filler is a shrink fit filler heat shrunk to be at least temporarily secured within the at least one groove.

20. The superabrasive compact of claim 13 wherein the superabrasive table comprises sintered polycrystalline diamond table.

21. The superabrasive compact of claim 13 wherein the substrate comprises a cemented carbide material.

22. A drill bit, comprising:

a bit body configured to engage an earthen formation;

a plurality of superabrasive cutting elements affixed to the bit body, at least one of the plurality of superabrasive cutting elements including:

a superabrasive table;

a substrate including an interfacial surface bonded to the superabrasive table, a base surface, and at least one peripheral surface extending between the base surface and the interfacial surface; and at least one liquid-metal-embrittlement-susceptibility-reducing feature including at least one groove formed in the at least one peripheral surface of the substrate at least proximate to the interfacial surface thereof, the at least one liquid-metal-embrittlement-susceptibility-reducing feature being at least partially unfilled and being positioned and configured to be exposed to a braze alloy when the substrate is brazed to the bit body.

23. A method of fabricating a drill bit, comprising:

providing a bit body configured to engage an earthen formation, the bit body including a plurality of recesses formed therein;

positioning at least one superabrasive compact in a corresponding one of the plurality of recesses, the at least one superabrasive compact including, a superabrasive table;

a substrate including an interfacial surface bonded to the superabrasive table, a base surface, and at least one peripheral surface extending between the base surface and the interfacial surface; and at least one liquid-metal-embrittlement-susceptibility-reducing feature including at least one groove formed in the at least one peripheral surface of the substrate at least proximate to the interfacial surface thereof, the at least one groove in the at least one liquid-metal-embrittlement-susceptibility-reducing feature being at least partially unfilled and being positioned and configured to be exposed to a braze alloy when the substrate is brazed to the bit body; and brazing the substrate of the at least one superabrasive compact to the bit body with a braze alloy.

24. A superabrasive compact, comprising:

a superabrasive table;

a substrate including an interfacial surface bonded to the superabrasive table, a base surface, and at least one peripheral surface extending between the base surface and the interfacial surface; and at least one liquid-metal-embrittlement-susceptibility-reducing feature including at least one groove formed in the at least one external peripheral surface of the substrate at least proximate to the interfacial surface thereof, the at least groove of the at least one liquid-metal-embrittlement-susceptibility-reducing feature being positioned and configured to be exposed to a braze alloy when the substrate is brazed to a body, the at least one groove at least partially unfilled with at least one of a curable paste, graphite, or a glass therein.

* * * * *